US006293669B1

(12) United States Patent
Uchida

(10) Patent No.: US 6,293,669 B1
(45) Date of Patent: Sep. 25, 2001

(54) INK JET RECORDING APPARATUS

(75) Inventor: Kota Uchida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/503,161

(22) Filed: Feb. 14, 2000

(30) Foreign Application Priority Data

Feb. 17, 1999 (JP) ..... 11-038075

(51) Int. Cl.[7] ..... B41J 2/01

(52) U.S. Cl. ..... 347/104; 400/611; 400/617; 400/636

(58) Field of Search ..... 347/101, 104; 400/611, 613, 613.1, 614, 617, 619, 636, 636.2, 625, 629

(56) References Cited

U.S. PATENT DOCUMENTS

| | | | | |
|---|---|---|---|---|
| 5,700,099 | * | 12/1997 | Kobayashi et al. | 400/625 |
| 5,874,979 | * | 2/1999 | Ohyama | 347/104 |
| 5,897,259 | * | 4/1999 | Ahn | 347/104 |
| 5,961,234 | * | 10/1999 | Uchikaia | 400/636 |
| 5,993,094 | * | 11/1999 | Lee | 400/636 |
| 6,062,685 | * | 5/2000 | Ohyama et al. | 347/104 |
| 6,113,289 | * | 9/2000 | Saito et al. | 400/611 |
| 6,155,728 | * | 12/2000 | Sakaiwo et al. | 400/636.2 |
| 6,183,152 | * | 2/2001 | Kumai et al. | 400/611 |

FOREIGN PATENT DOCUMENTS

| | | |
|---|---|---|
| 59-188467 | 10/1984 | (JP) . |
| 9-193373 | 7/1997 | (JP) . |

* cited by examiner

*Primary Examiner*—Eugene Eickholt
(74) *Attorney, Agent, or Firm*—Fitzpatrick, Cella, Harper & Scinto

(57) ABSTRACT

An ink jet recording apparatus which performs recording on a recording medium using an ink jet recording head comprises an ink jet recording area where ink jet recording is performed, a conveyance route where the recording medium is conveyed in the ink jet recording area, while being opposed to the ink jet recording head, a conveying roller provided on the upstream side of the conveyance route in the ink jet recording area for guiding the recording medium to the ink jet recording area, a plurality of pinch rollers provided at predetermined intervals in the axial direction of the conveying roller, the pinch rollers sandwiching the recording medium to effect conveyance together with the conveying roller, and a controlling rotary member at a position shifted from the recording surface side of the recording medium to the back side with respect to the conveyance route on the downstream side of the ink jet recording area in the conveyance route and making contact with the recording surface side of the recording medium to shift the recording medium to the back side. A controlling rotary member is placed on the downstream side of the conveyance route corresponding to every gap portion between adjacent pinch rollers.

21 Claims, 8 Drawing Sheets

INK JET RECORDING APPARATUS

BACKGROUND OF THE INVENTION

1. Field of the Invention

The present invention relates to an ink jet recording apparatus which performs ink jet recording on a recording material (recording medium) with an ink jet recording means, and more specifically relates to an ink jet recording apparatus provided with a conveying means for conveying a recording material which can generate concave and convex deformation.

2. Related Background Art

As a recording apparatus having a function such as a printer, a copier, a facsimile or the like, or a recording apparatus used as an output apparatus such as a composite type electronic apparatus or a work station including a computer or a word processor or the like, an ink jet recording type apparatus which discharges ink onto a recording material (recording medium) such as paper, cloth, a plastic sheet, an OHP sheet or the like based on image information (recording information) to perform recording is becoming widespread. Further, there are various needs for qualities of these recording materials. Recently, developments for these needs have been made, and recording apparatuses, which record on cloth, leather, a nonwoven cloth, or metal or the like, as well as paper including thin paper or processed paper, or a resin sheet (OHP sheet and the like) or the like, which are usual recording materials, are also used.

In the above-mentioned recording apparatuses such as a printer, a copier, a word processor, a personal computer, a facsimile, and the like, a conveyance mechanism for the recording material, provided with a conveying roller for conveying the recording material, a plurality of pinch rollers arranged in a straight line for pressing against the conveying roller, a plurality of expelling rollers arranged in a straight line for expelling the recorded recording material, a plurality of expelling spurs (expelling rotary members) arranged opposingly to the paper expelling rollers for expelling the recording material, is used.

FIG. 8 is a partial plan view showing the main portion of a recording material conveying mechanism of a conventional recording apparatus. In FIG. 8, a recording material (not shown) is sandwiched between a conveying roller 4 and a pinch roller 5 split in plural portions and is recorded while it is conveyed along a platen 10 arranged opposingly to a recording portion. A recorded recording material (not shown) is expelled while being sandwiched between expelling rollers 11 and expelling spurs (expelling rotary members) 12. As shown in FIG. 8, the expelling rollers 11 and the expelling spurs 12 are positioned in the width direction (a direction perpendicular to the conveyance direction of the recording material) of the recording material (not shown) so that respective pairs are opposed to each other. In the configuration of FIG. 8, paper holding spurs (paper holding rotary members) which will be described later are not provided.

Japanese Laid-Open Patent Application No. 59-188467 describes an ink jet printer which conveys a paper to a position opposed to an ink jet printing head with a platen roller and two pinch rollers which sandwich the vicinities of both ends of the paper respectively, and prevents lifting of the paper from the platen roller with a roller having a number of saw-tooth protrusions between two paper holding rollers which sandwich the vicinities of the both ends of the paper respectively at the downstream side, thereby to prevent contact between the printing head and the paper.

However, since the paper is pressed with the platen roller only in the vicinities of both ends and the roller having the saw-tooth protrusions is spaced from the platen roller, contact between the printing head and the paper cannot be positively prevented. Particularly, in a case where an amount of application of ink droplets to the paper is significantly increased as in full-color printing and the like, such problems remarkably occur.

Japanese Laid-Open Patent Application No. 9-193373 discloses an ink jet printer provided with paper holding spurs for holding the recording material so as to prevent recorded recording material from being deformed into a convex shape. The paper holding spurs have no opposed expelling rollers. Further, a recording apparatus has also been provided, which is formed so that expelling of the recording material is carried out while controlling generation of concave and convex shaped deformations in the recording material (so called cockling), by providing a paper holding spur having no opposed expelling roller with a pressing means and always pressing the recording material to previously deform the recording material portion opposed to the paper holding spur to a concave shaped portion. FIG. 9 is a partial plan view showing the main portion of a conventional recording material conveying mechanism provided with paper holding spurs having no opposed expelling rollers.

However, such conventional recording material conveying mechanisms as shown in FIGS. 8 and 9 have the following disadvantages. First, in such a conveying mechanism having no paper holding spurs as shown in FIG. 8, a convex shaped deformation of the recording material easily occurs at the downstream side portion of a gap portion between adjacent pinch rollers in the recording material conveyance direction, and the recording material is brought into contact with a recording means (recording head) whereby the recording surface of the recording material is stained.

Second, even in a conveying mechanism provided with paper holding spurs 14, in a case where split pinch rollers 5 are provided as shown in FIG. 9, the positions of pinch rollers 5 which press the upstream side of the recording area in the recording material and the positions of expelling spurs 12 and paper holding spurs 14 which press the downstream side thereof are in the width direction of the recording material. As a result, the positions where the recording material is pressed are defined with pitches having no interrelationship between the upstream side and the downstream side of the recording area. Thus, the balance of positions where the recording material is pressed is bad. Accordingly, even if paper holding spurs are placed at the downstream side, the recording material is deformed in a concave (not convex) shape in the recording area and positions of occurrence of concave and convex portions due to cockling of the recording material cannot be controlled. As a result, the recording material is brought into contact with a recording head whereby the recording surface is stained.

SUMMARY OF THE INVENTION

The present invention was made in consideration of these technical problems. The object of the present invention is to provide an ink jet recording apparatus which has a simple configuration and can positively prevent contact of a recording medium being conveyed with an ink jet recording means whereby an ink stain on the recording surface of the recording medium can be prevented.

Another object of the present invention is to provide an ink jet recording apparatus which can positively control a position of occurrence of concave and convex shaped deformations which can occur in a recording medium conveyed while being sandwiched between a conveying roller and a pinch roller whereby contact between the recording medium and an ink jet recording means can be prevented.

Another object of the present invention is to provide an ink jet recording apparatus which can prevent contact of a portion deformed in a convex shape which easily occurs in a portion corresponding to a gap portion between adjacent pinch rollers of a recording medium conveyed while being sandwiched between a conveying roller and a pinch roller.

Still another object of the present invention is to provide an ink jet recording apparatus comprising an ink jet recording area where ink jet recording is performed on a recording medium with ink jet recording means, a conveyance route where said recording medium is conveyed in said ink jet recording area while being opposed to said ink jet recording means, a conveying roller provided on the upstream side of said conveyance route in said ink jet recording area for guiding said recording medium to said ink jet recording area, a plurality of pinch rollers provided with predetermined intervals in the axial direction of said conveying roller for sandwiching said recording medium to convey together with said conveying roller, and a controlling rotary member positioned at a portion shifted from the recording surface side of said recording medium to the back side with respect to said conveyance route on the downstream side of said ink jet recording area in said conveyance route and making contact with the recording surface side of the recording medium to shift the recording medium to said back side, said controlling rotary member being placed on the downstream side of said conveyance route corresponding to every gap portion between adjacent pinch rollers.

DETAILED DESCRIPTION OF THE PREFERRED EMBODIMENTS

Figure 1:
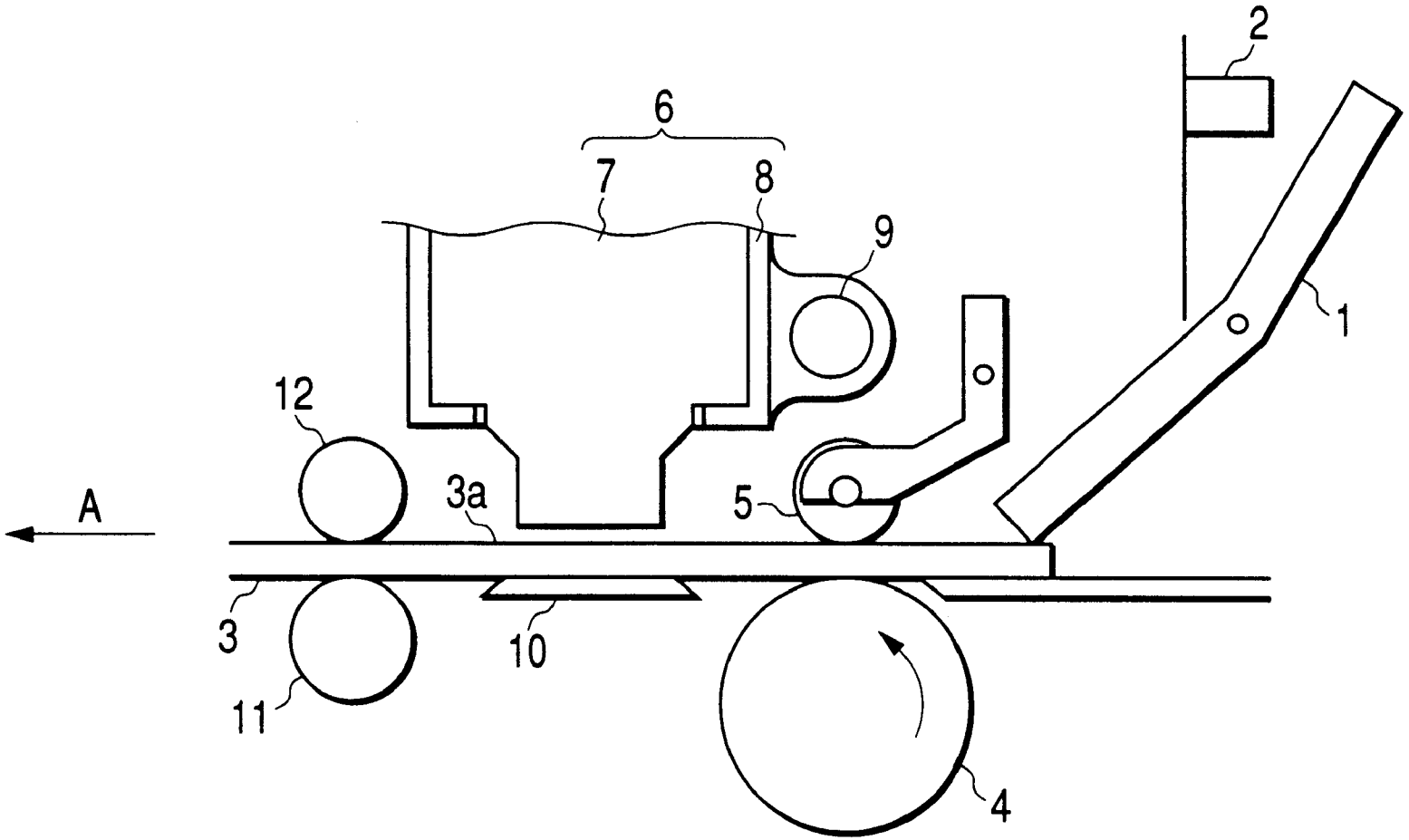
FIG. 1 is a schematic side view showing a recording material conveyance route of a recording apparatus to which the present invention is preferably applied.

Embodiments of the present invention will be described with reference to the drawings. FIG. 1 is a schematic side view showing a recording material conveyance route of a recording apparatus to which the present invention is preferably applied. In FIG. 1, the reference numeral 4 denotes a conveying roller, and the reference numeral 5 denotes a pinch roller. The pinch roller 5 is biased or pressed against the conveying roller 4 with a spring (not shown). The pinch roller 5 conveys a recording material 3 in the conveyance direction (in a direction of an arrow A in FIG. 1) in cooperation with the conveying roller 4. The conveying roller 4 is driven to rotate by a conveying motor (not shown). The recording material 3 is conveyed by a predetermined amount by a corresponding predetermined amount of rotation of the conveying roller 4.

A PE sensor lever 1 and a PE sensor 2 are provided on the upstream side in the direction of the recording material conveyance with respect to the above-mentioned conveying roller 4 and the pinch roller 5 and form a recording material detecting means which detects the presence or absence of the recording material 3 and the end portion thereof. In the apparatus body is placed a guide shaft 9 extending in a direction perpendicular to the conveyance direction A of the recording material 3. Along this guide shaft 9 is reciprocatively guided and supported a carriage 8. On the carriage 8 is mounted a recording head 7 used as a recording means. This recording head 7 forms (records) an image on the recording material 3 conveyed on a platen 10 with the conveying roller 4 and the pinch roller 5. Thus, a recording portion 6 is formed by the recording head 7 and the carriage 8 provided at a position opposed to the platen 10.

The above-mentioned recording head 7 is an ink jet recording head in which ink is selectively discharged from a plurality of discharge ports to record by applying energy in response to a recording signal. Further, the recording head 7 discharges ink by the use of thermal energy and is provided with an electrothermal converting element for generating the thermal energy. Further, the recording head 7 discharges ink from discharge ports by utilizing a pressure change which is generated by growth and shrinkage of a bubble due to a film boiling generated by the thermal energy applied with said electrothermal converting element, thereby effecting recording. An electrothermal converting element is correspondingly provided for each of the discharge ports, and ink is discharged from the corresponding discharge ports by applying voltage pulses to the corresponding electrothermal converting elements in response to recording signals.

Figure 5:
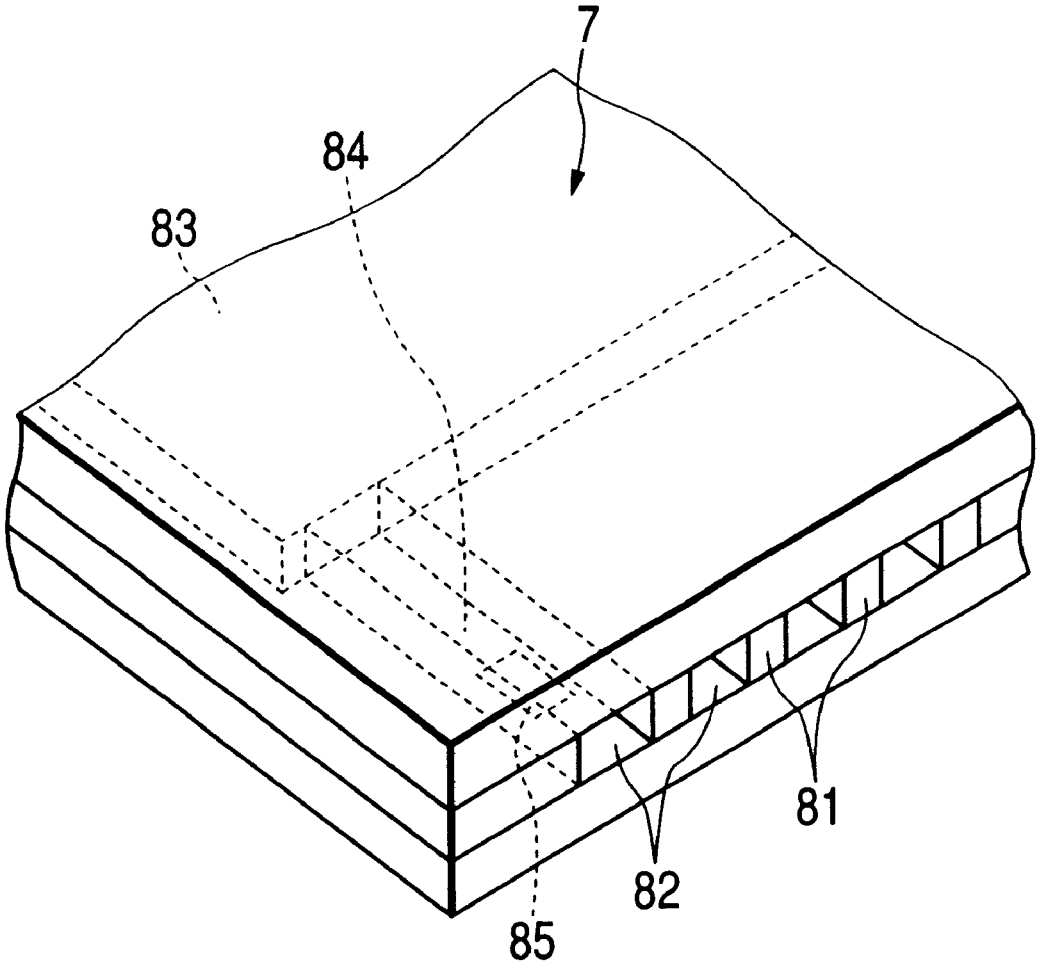
FIG. 5 is a partial perspective view schematically showing a structure of an ink discharge portion of the recording means of FIG. 1.

FIG. 5 is a partial perspective view schematically showing a structure of an ink discharge portion (a row of discharge ports) of the recording head 7. In FIG. 5, a plurality of discharge ports 82 are formed with a predetermined pitch in discharge surfaces 81 opposing to the recording material 3 with a predetermined gap (for example, about 0.3 mm to 2.0 mm) and an electrothermal converting element (heating resistor or the like) 85 for generating ink discharging energy is provided along the wall surface of each liquid path 84 communicating between a common liquid chamber 83 and each discharge port 82. The recording head 7 is guided and supported in a positional relation such that the discharge ports 82 are aligned in a direction which crosses the main scanning direction (in the present example in which the recording head 7 is mounted on the carriage 8, a direction of movement of the carriage 8). Thus, there is configured the recording head 7 which drives (application of a pulse voltage) the corresponding electrothermal converting elements 85 based on image signals or discharge signals to allow film-boiling of ink in the liquid path 84 and discharge ink droplets from discharge ports 82 by pressure which is generated in the boiling.

In FIG. 1, the reference numeral 12 denotes an expelling spur used as an example of an expelling rotary member. The expelling spur is pressed against an expelling roller 11 with a spring (not shown) thereby to function as a pinch roller for the expelling roller 11. Both the expelling roller 11 and expelling spur 12 discharge a recording material 3 on a discharge tray (not shown) in cooperation with each other without staining recorded surface 3*a* of the recording material 3. Incidentally, the spur includes an element on its circumference which continuously or intermittently makes contact with the recording material.

Figure 2:
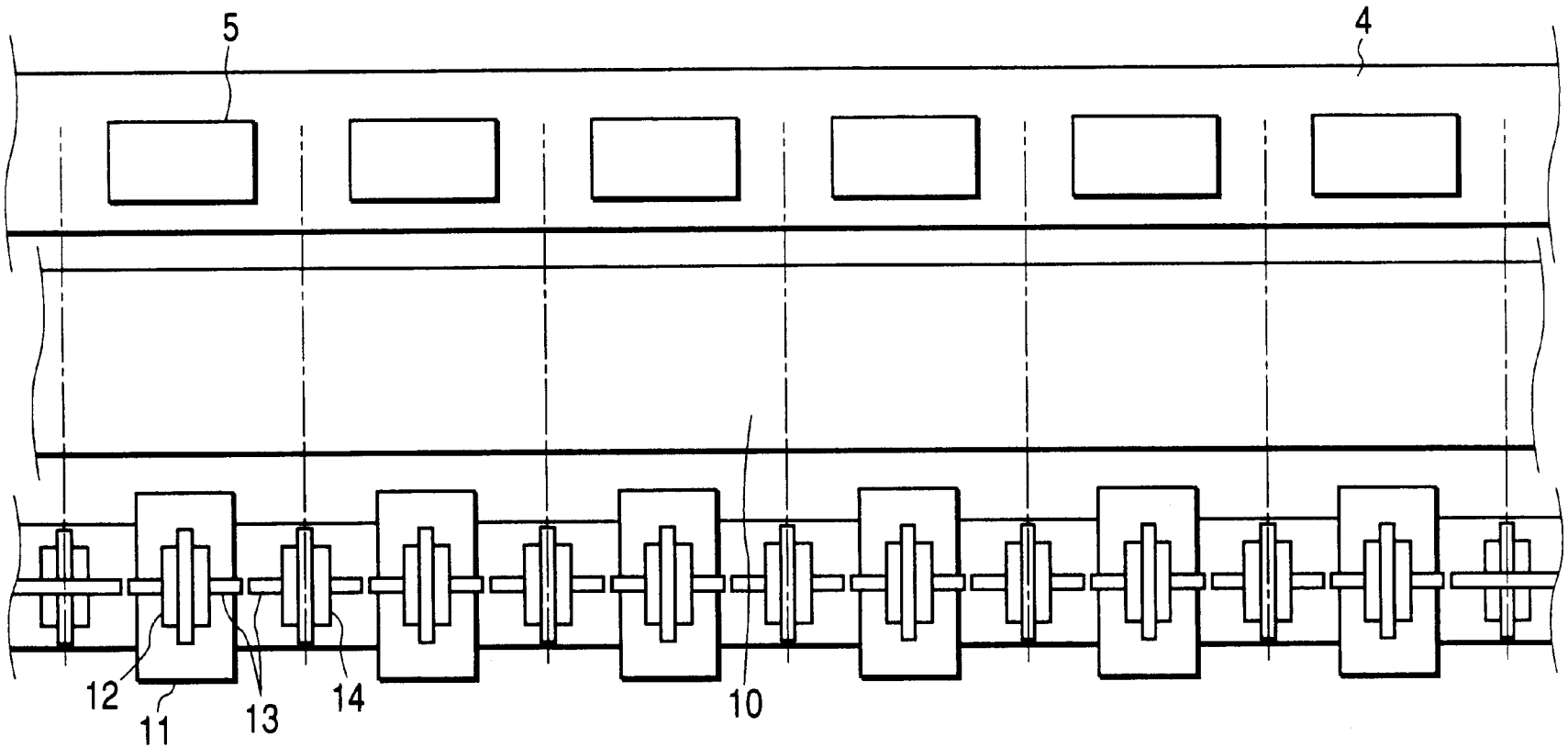
FIG. 2 is a partial plan view of a recording material conveying means of a recording apparatus to which the present invention is applied, when viewed from above.

FIG. 2 is a partial plan view of a recording material conveying means of a recording apparatus to which the present invention is applied, when viewed from above. In FIG. 2, a plurality of pinch rollers 5 are arranged against a conveying roller 4 in a straight line. The reference numeral 14 denotes a paper holding spur used as an example of a restricting or controlling rotary member. A plurality of paper holding spurs 14 are arranged at positions on the downstream side in a direction of the recording material conveyance with respect to all gap portions between pinch rollers 5. That is, each of the paper holding spurs 14 is placed on a position on the downstream side in a direction of the recording material conveyance with respect to all gap portions between adjacent pinch rollers 5. In this case, the paper holding spurs 14 need not be placed on edge portions in a width direction of the recording material where the recording material is not passed, and may be placed on the downstream side of areas where the recording material is substantially passed with respect to all gap portions between adjacent pinch rollers.

Further, a plurality of expelling rollers (expelling rollers 11) for expelling recorded recording material 3 and a plurality of expelling spurs (expelling spurs 12) arranged so as to cooperate with each of the expelling rollers 11 for expelling the recording material 3 are positioned in a direction crossing the conveyance direction of the recording material 3 while forming pairs respectively. The reference numeral 13 denotes closely wound springs. Each closely wound spring 13 has a function of pressing each expelling spur 12 or each paper holding spur 14 against the recording material 3. In the configuration of FIG. 2, each of the paper holding spurs 14 is on a straight line with respect to each of expelling spurs 12 when viewed from above, and is alternately arranged with respect to each of the expelling spurs 12.

As shown in FIG. 2, a recording material portion which is easily deformed in a convex shape after recording, that is, a recording material portion on the downstream side in a direction of the recording material conveyance with respect to a gap portion between the adjacent pinch rollers 5, is prevented from contacting the recording head 7 by providing the pinch rollers 5, the expelling spurs 12 and the paper holding spurs 14, whereby the recorded surface 3*a* of the recording material can be prevented from being stained. Additionally, the respective positions of pinch rollers 5 which press the upstream side of the recording area in the recording material and the respective positions of expelling spurs 12 and paper holding spurs 14 which press the downstream side of the recording area were selected as having balanced pitches and a correlation therebetween as mentioned above in FIG. 2. Accordingly, a position of occurrence of concave and convex deformations of the recording medium 3, that is, cockling, can be positively controlled, whereby the staining of the recorded surface 3*a* due to the contact of the recording material 3 with the recording head 7 can be prevented.

Figure 3:
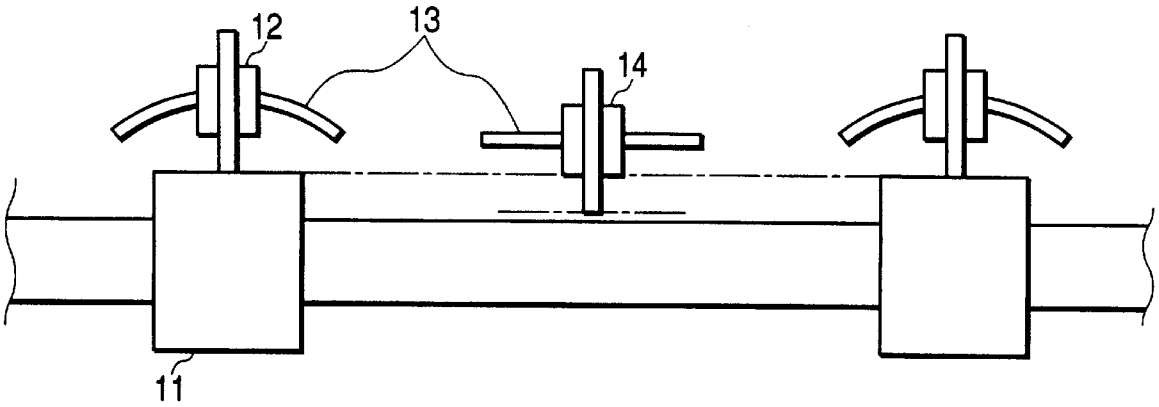
FIG. 3 is a partial front view for explaining relative vertical positions of an expelling spur and paper holding spur with respect to an expelling roller of the recording material conveying means of FIG. 2.

FIG. 3 is a partial front view for explaining relative vertical positions of an expelling spur 12 and a paper holding spur 14 with respect to an expelling roller 11 of the recording material conveying means of FIG. 2. In FIG. 3, the paper holding spur 14 is provided so that its lower surface is positioned at a position lower than the upper surface of the expelling roller 11. By selecting the level of the paper holding spur 14 as mentioned above, a recording material portion which is easily deformed in a convex shape after recording, that is, a recording material portion on the downstream side in a direction of the recording material conveyance with respect to a gap portion between the adjacent pinch rollers 5, can be positively deformed in a concave shape, whereby the staining of the recorded surface 3*a* of the recording material 3 due to the contact of the recording material with the recording head 7 can be positively prevented.

Further, as shown in FIG. 2, by providing the expelling spurs 12 and the paper holding spurs 14 which press the downstream side of a recording area in the recording material in a straight line when viewed from above, variations in positions which press the downstream side of the recording area in the recording material can be reduced. Accordingly, the upstream side and the downstream side of the recording area in the recording material 3 can be held in a better balance and a position of occurrence of concave and convex deformations of the recording material 3, that is, cockling, can be positively controlled. Therefore, staining of the recorded surface 3*a* due to the contact of the recording material 3 with the recording head 7 can be prevented.

Figure 4:
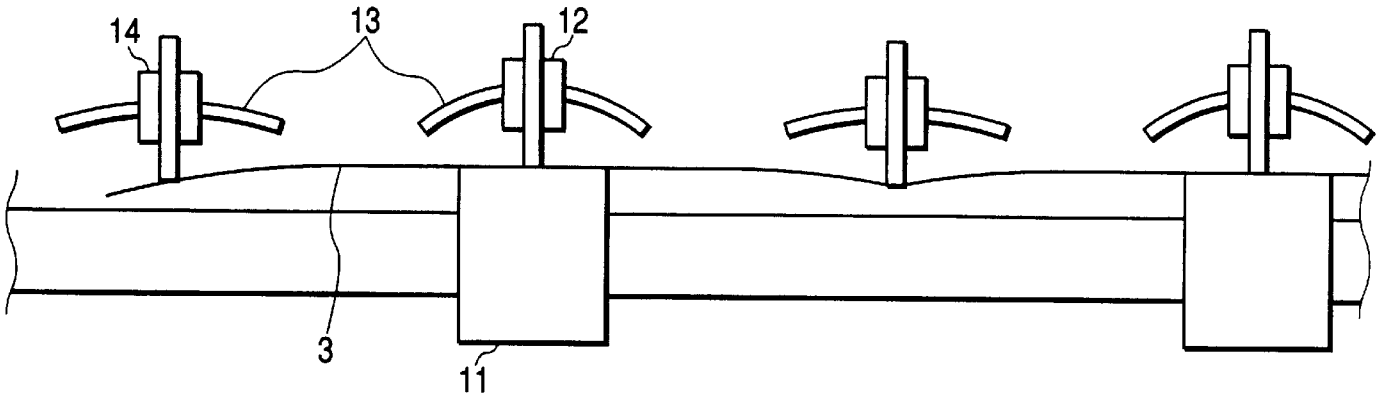
FIG. 4 is a partial front view showing a state where the end portion of a recording material is held with paper holding spurs in the recording material conveying means of FIG. 2.

FIG. 4 is a partial front view showing a state where the edge portion of a recording material 3 is held with a paper holding spur 14 in the recording material conveying means of FIG. 2. In the recording material conveying mechanism explained in FIGS. 2 and 3, contact of an edge portion of the recording material 3 with the recording head 7 due to warpage of the edge portion of the recording material 3 can be prevented, not by the paired expelling roller 11 and expelling spur 12, but by the paper holding spur 14 positioned at the edge portion in the width direction of the recording material 3, as shown in FIG. 4. That is, one of the paper holding spurs 14 is positioned at the edge portion of the recording material 3 so that it holds the edge portion of the recording material 3 in the width direction, whereby the staining of the edge of the recorded surface 3*a* of the recording material and the damaging of the recording head 7 due to the warpage of the edge portion of the recording material 3 and the contact of the edge portion with the recording head 7 can be prevented. Further, by providing a paper holding spur 14 positioned at the edge portion of the recording material 3 so that the lower surface of the paper holding spur 14 is positioned at a place lower than the upper surface of the expelling roller 11, the contact of the recording material 3 with the recording head 7 can be further positively prevented.

Figure 6:
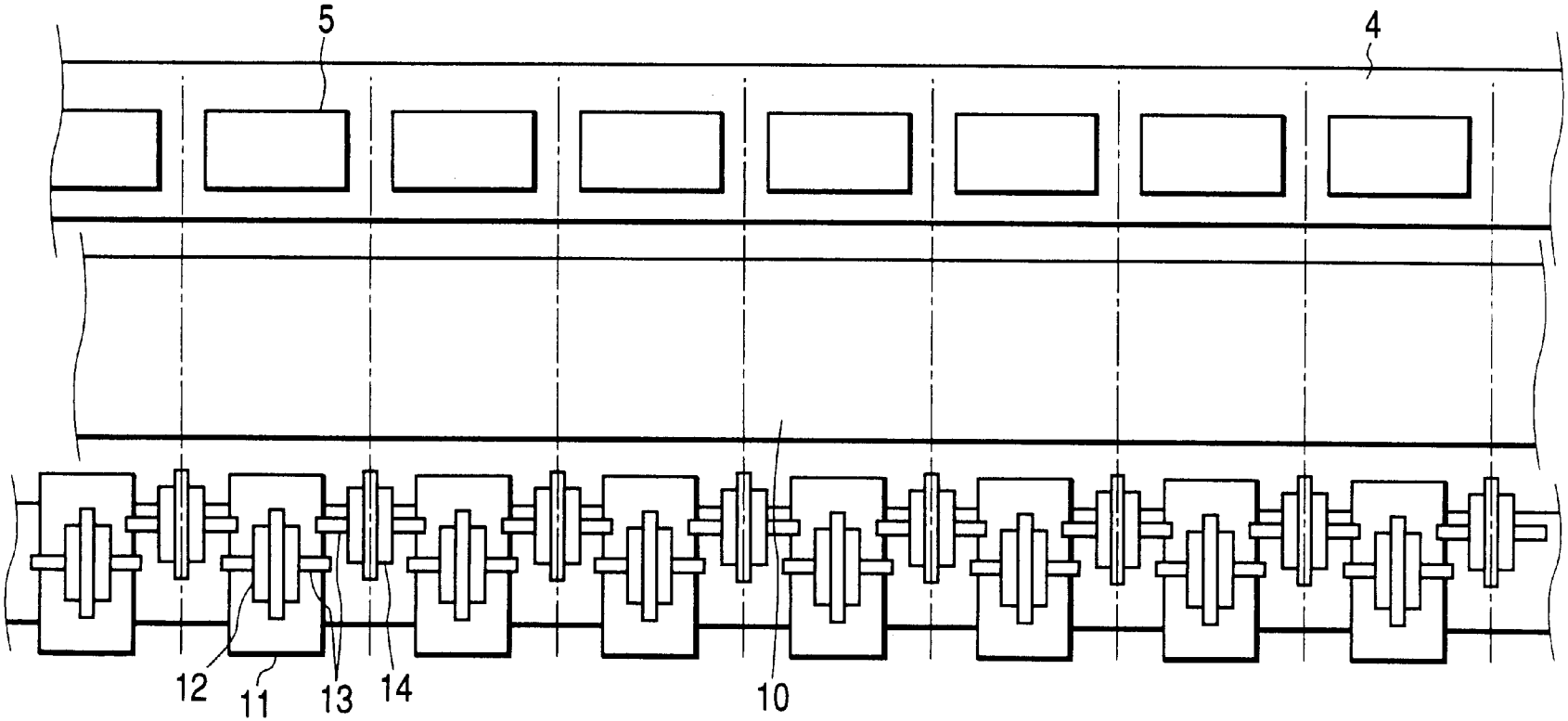
FIG. 6 is a partial plan view of the main portion of a recording material conveying mechanism of a second example of a recording apparatus to which the present invention is applied, when viewed from above.

FIG. 6 is a partial plan view of the main portion of a recording material conveying mechanism of a second example of a recording apparatus to which the present invention is applied, when viewed from above. The second example is different from the first example mentioned above in that an arrangement of the paper holding spurs 14 with respect to the expelling spurs 12 is changed. That is, in FIG. 6 the paper holding spurs 14 are provided on a row different from a row of the expelling spurs 12 when viewed from above. That is, the paper holding spurs 14 are not provided in the same straight line as the expelling spurs 12 are provided. The second example of FIG. 6 is different from the first example of FIG. 2 in this point. However other points are substantially the same. Thus, the corresponding parts are denoted by the same reference numerals and the details thereof are omitted.

According to the second example of FIG. 6, the gap between the adjacent paper holding spur 14 and the expelling spur 12 can be further narrowed than in a case where the paper holding spurs 14 and the expelling spurs 12 are arranged in a straight line as shown in FIG. 2. The number of the alternately arranged paper holding spurs 14 and expelling spurs 12 can be increased by the narrowed gap. Therefore, the magnitude of concave and convex deformations, that is, cockling of the recording material 3, can be decreased and the staining of the recorded surface of the recording material 3 due to the contact of the recording material 3 with the recording head 7 can be further effectively prevented.

Further, in the second example of FIG. 6, by providing paper holding spurs 14 so that the lower surfaces of the paper holding spurs 14 are positioned at places lower than the upper surfaces of the expelling rollers 11 as shown in FIG. 3, a recording material portion which is easy to be deformed in a convex shape after recording, that is, a recording material portion on the downstream side in the conveyance direction of the recording material with respect to a gap portion between the adjacent pinch rollers 5, can also be positively deformed in a concave shape, whereby the staining of the recorded surface 3*a* of the recording material 3 due to the contact of the recording material 3 with the recording head 7 can be positively prevented. Additionally, as shown in FIG. 4 of the first example, by arranging a plurality of paper holding spurs 14 such that a paper holding spur 14 (not a paired expelling roller 11 and expelling spur 12) is positioned at each edge portion of the recording material 3, the staining of the edge of the recorded surface 3*a* of the recording material due to the contact of the edge portion with the recording head 7, which is generated by the warpage of the edge portion of the recording material 3, can be prevented.

Figure 7:
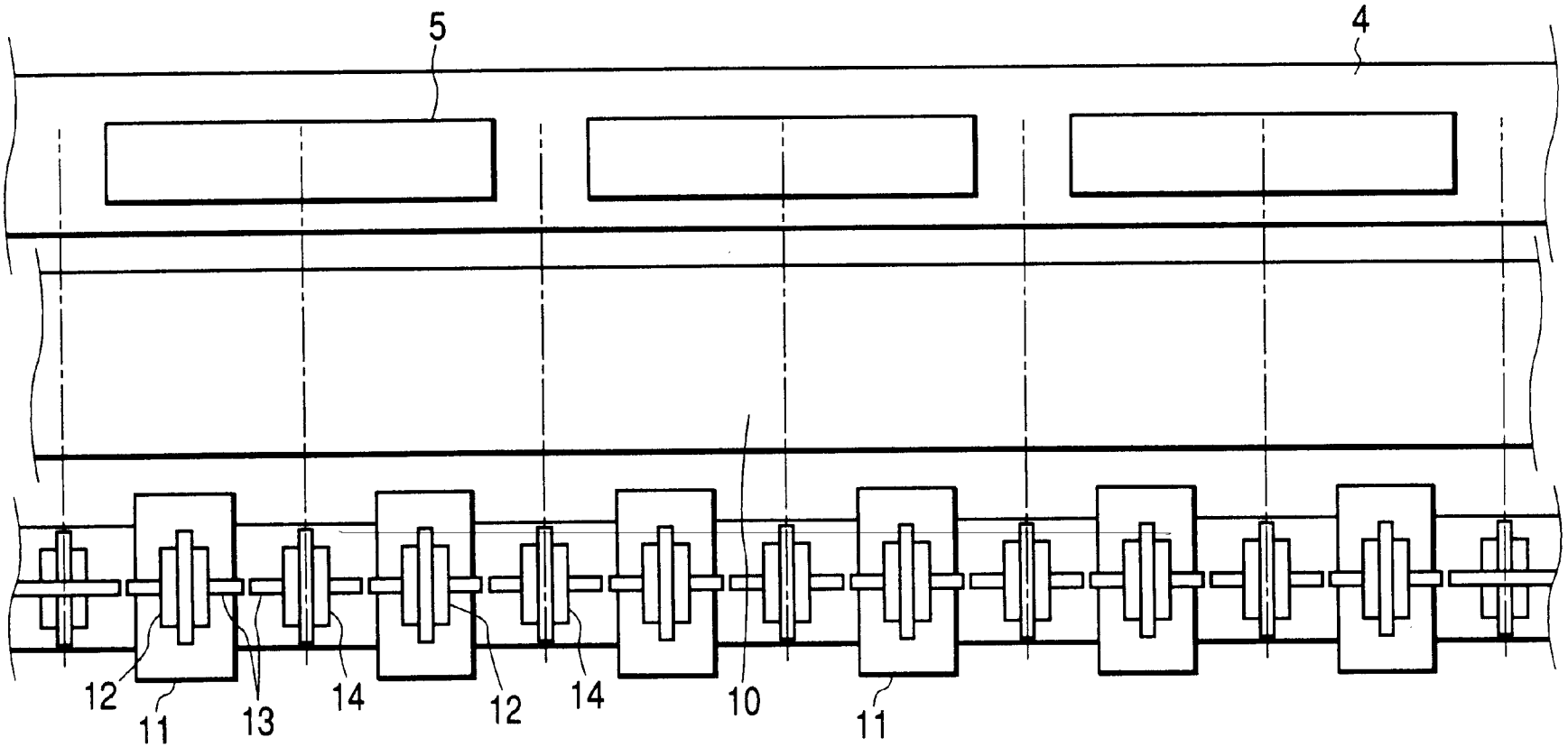
FIG. 7 is a partial plan view of the main portion of a recording material conveying mechanism of a third example of a recording apparatus to which the present invention is applied, when viewed from above.
Figure 8:
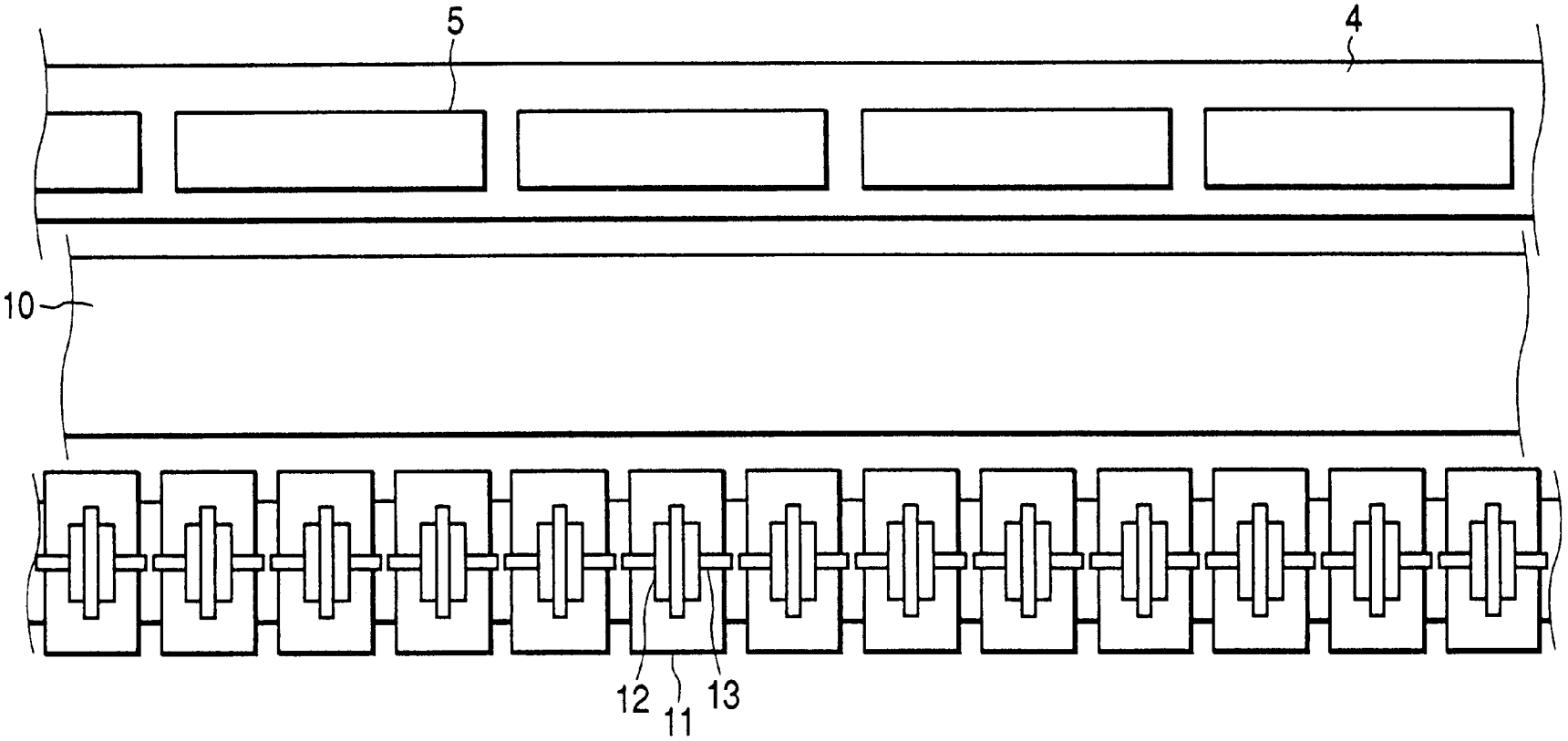
FIG. 8 PRIOR ART
FIG. 8 is a partial plan view showing the main portion of a recording material conveying mechanism of a conventional recording apparatus.
Figure 9:
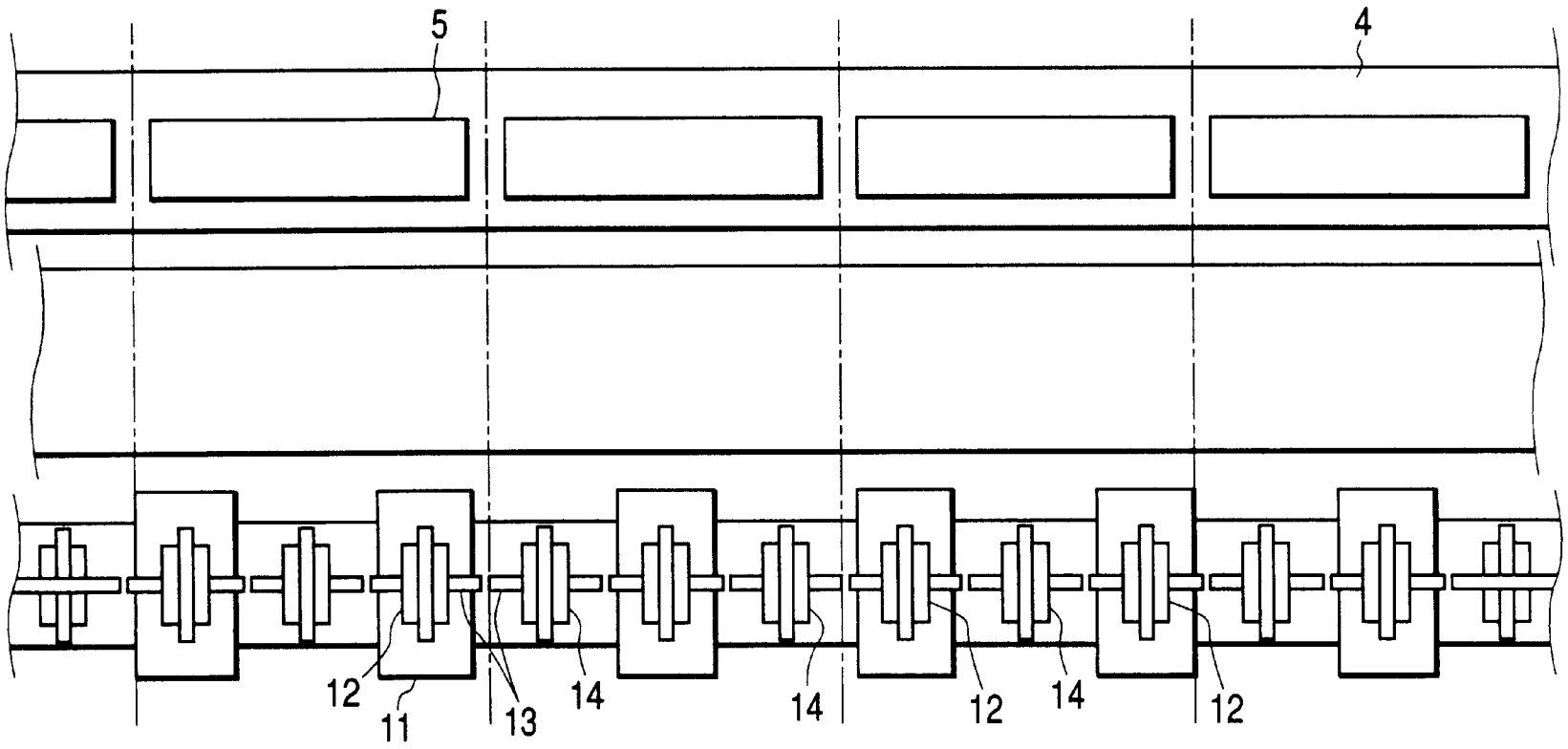
FIG. 9 is a partial plan view showing the main portion of a conventional recording material conveying mechanism provided with paper holding spurs and having no opposed expelling rollers.

FIG. 7 is a partial plan view of the main portion of a recording material conveying mechanism of a third example of a recording apparatus to which the present invention is applied, when viewed from above. The present example shows a configuration which can be preferably carried out when the number of the pinch rollers 5 is small, that is, the length of each pinch roller 5 is long. In FIG. 7, the number of split pinch rollers is small and the length of each pinch roller is comparatively long. Thus, a plurality of paper holding spurs 14 are placed on each position on the downstream side in a direction of the recording material conveyance with respect to a gap portion between the adjacent pinch rollers 5 and on each position on the downstream side in a direction of the recording material conveyance with respect to each pinch roller 5 (substantially the center thereof).

According to the third example of FIG. 7, even if the number of the split pinch rollers is small and each pinch roller is long, the contact of a recording material portion which is easily deformed in a convex shape after recording, that is, a recording material portion on the downstream side in a direction of the recording material conveyance with respect to a gap portion between the adjacent pinch rollers 5, with the recording head 7 can be positively prevented, and at the same time the contact of a portion of the recording material 3 on the downstream side in the direction of the recording material conveyance with respect to a pinch roller pressing portion with the recording head 7 can be also positively prevented, whereby the staining of a recorded surface 3*a* of the recording material 3 and damage of the recording head 7 can be prevented.

Further, in the third example of FIG. 7, the respective positions of pinch rollers 5 which press the upstream side of the recording area on the recording material and the respective positions of expelling spurs 12 and paper holding spurs 14 which press the downstream side of the recording area can also be selected to have balanced pitches and a correlation therebetween as in the case of the first example. Accordingly, a position of occurrence of concave and convex deformations of the recording medium 3, that is, cockling, can be positively controlled, whereby the staining of the recorded surface 3*a* and damage of the recording head 7 due to the contact of the recording material 3 with the recording head 7 can be prevented. Further, in the third example, by providing paper holding spurs 14 so that their lower surfaces are positioned lower than the upper surfaces of the expelling rollers 11 as shown in FIG. 3 relating to the first example, a recording material portion which is easily deformed in a convex shape after recording, that is, a recording material portion on the downstream side in the direction of the recording material conveyance with respect to a gap portion between the adjacent pinch rollers 5, can also be positively deformed in a concave shape, whereby the staining of the recorded surface 3*a* of the recording material 3 and damage of the recording head 7 due to the contact of the recording material 3 with the recording head 7 can be positively prevented.

Additionally, in the third example of FIG. 7, by arranging a plurality of paper holding spurs 14 such that a paper holding spur 14 (not a paired expelling roller 11 and expelling spur 12) is positioned at each edge portion of the recording material 3, the staining of the edge of the recorded surface 3*a* of the recording material due to the contact of the edge portion with the recording head 7, which is generated by the warpage of the edge portion of the recording material 3, can be prevented.

In the above-mentioned examples, serial-type recording apparatuses which perform recording while relatively moving the recording head 7 with respect to the recording material 3 were described. However, the present invention can also be applied to a line-type recording apparatus which performs recording with only secondary scanning using a line-type recording head having a length covering the whole width of a recording material or a part of the width thereof. In a case where a large amount of ink droplets can adhere to the whole surface of the recording material at a time, further advantageous effects can be obtained.

Further, the present invention can also be applied to a recording apparatus using one recording head, a color recording apparatus using a plurality of recording heads which record with different colors, a gradation recording apparatus using a plurality of recording heads which record with the same colors at different color concentrations, or a recording apparatus for performing image recording by a combination thereof. Thus, since a large amount of ink droplets can adhere to the whole surface of the recording material in image recording, further advantageous effects can be obtained.

Further, the present invention of the ink jet recording apparatus can also be applied to any case where any arrangement configuration of the recording head and the ink tank is used, such as cases where a recording head and ink tank-integrated exchangeable ink cartridge are used, a recording head and an ink tank are separately formed and the connection therebetween is made with an ink supply tube etc., and the like, and the same effects can be obtained in any case.

Further, the present invention can also be applied to a case where an ink jet recording apparatus uses an electromechanical converting element or the like, for example, a piezoelectric element or the like. However, further excellent effects can be obtained by an ink jet recording apparatus which discharges ink using thermal energy. According to such an ink jet recording apparatus, high density and high definition recording can be attained.

As apparent from the above descriptions, according to the present invention, there is provided a recording apparatus comprising a recording portion which performs recording on a recording material, a conveying roller for conveying the recording material, a plurality of pinch rollers pressed against the conveying roller, a plurality of expelling rollers for expelling a recorded recording material, a plurality of expelling spurs arranged so as to cooperate with each expelling roller for expelling the recording material, and a plurality of paper holding spurs for preventing the lifting of the recording material, wherein each of the paper holding spurs is provided on the downstream side in the direction of the recording material conveyance with respect a gap portion between adjacent pinch rollers. Accordingly, the contact of a recording material portion which is easily deformed in a convex shape after recording, that is, a downstream side portion in the direction of the recording material conveyance with respect to a gap portion between adjacent pinch rollers, with a recording means can be prevented by such a simple configuration. As a result, a recording apparatus is provided in which the contact of the recording material with the recording means which can be generated in conveyance of the recording material can be positively prevented, whereby the staining of the recorded surface of the recording material can be prevented.

Further, according to the present invention, paper holding spurs are provided so that their lower surfaces are positioned lower than the upper surfaces of the expelling rollers. Accordingly, a recording apparatus which can efficiently attain the above-mentioned effects is provided.

Further, according to the present invention, the expelling spurs and the paper holding spurs are provided in a straight line. Accordingly, variations of the downstream side positions in a recording area of the recording material, which are pressed, can be reduced, and a balance between the pressed upstream side and downstream side positions in the recording area of the recording material can be further improved. Accordingly, the staining of a recorded surface of the recording material due to the contact of the recording material with the recording means can be further efficiently prevented.

Further, according to the present invention, the expelling spurs and the paper holding spurs are arranged at different positions in the direction of the recording material conveyance. Accordingly, the gap between the expelling spur and the paper holding spur can be narrowed and the number of the expelling spurs and paper holding spurs can be increased. Thus, the magnitude of concave and convex deformation, so-called cockling of the recording material, can be decreased. As a result, the staining of a recorded surface of the recording material due to the contact of the recording material with the recording means can be further efficiently prevented.

According to the present invention, there is provided a recording apparatus comprising a recording portion which performs recording on a recording material, a conveying roller for conveying the recording material, a plurality of pinch rollers pressed with the conveying roller, a plurality of expelling rollers for expelling a recorded recording material, a plurality of expelling spurs arranged so as to cooperate with each expelling roller for expelling the recording material, and a plurality of paper holding spurs for holding the lifting of the recording material, wherein each of the paper holding spurs is provided on the downstream side in the direction of the recording material conveyance with respect to the gap portion between adjacent pinch rollers and each of the paper holding spurs is also provided on the downstream side in the direction of the recording material conveyance with respect to the gap portion between adjacent pinch rollers. Accordingly, even if the pinch roller is long, contact of a recording material portion which is easily deformed in a convex shape after recording, that is, a downstream side portion in the direction of the recording material conveyance with respect to a gap portion between adjacent pinch rollers, with a recording means can be prevented by such a simple configuration. As a result, a recording apparatus, which can positively prevent the contact of the recording material with the recording means, which can be generated in conveyance of the recording material, thereby to prevent the staining of the recorded surface of the recording material, is provided.

Further, according to the present invention, paper holding spurs are provided so that their lower surfaces are positioned lower than the upper surfaces of the expelling rollers. Accordingly, even if the pinch roller is long, a recording apparatus which can efficiently attain the above-mentioned effects by such a simple configuration is provided.

Further, according to the present invention, a paper holding spur is provided on each edge portion in the width direction of the recording material. Accordingly, in addition to the above-mentioned effects, a recording apparatus which can prevent the staining of the edge portion of the recording material due to the contact of the edge portion of the recording material with the recording head, which is generated by warpage thereof, is provided.

Further, according to the present invention, a paper holding spur positioned at each edge portion of the recording material is provided so that the lower surface of the paper holding spur is positioned lower than the upper surface of the expelling roller. Accordingly, in addition to the above-mentioned effects, even if the pinch roller is long, the staining of edge portion of the recording material due to the contact of the edge portion of the recording material with the recording head, which is generated by warpage thereof, can be further positively prevented.

What is claimed is:

1. An ink jet recording apparatus which performs recording on a recording medium using an ink jet recording means, comprising:

an ink jet recording area where ink jet recording is performed on a recording medium with the ink jet recording means;

a conveyance route where the recording medium is conveyed in said ink jet recording area, while being opposed to the ink jet recording means;

a conveying roller provided on the upstream side of said conveyance route in said ink jet recording area for guiding the recording medium to said ink jet recording area;

a plurality of pinch rollers provided at predetermined intervals in the axial direction of said conveying roller, said pinch rollers sandwiching the recording medium to effect conveyance together with said conveying roller; and a controlling rotary member at a position shifted from the recording surface side of the recording medium to the back side with respect to said conveyance route on the downstream side of said ink jet recording area in said conveyance route and making contact with the recording surface side of the recording medium to shift the recording medium to the back side, said controlling rotary member being positioned on the downstream side of said conveyance route corresponding to every gap portion between adjacent pinch rollers.

2. An ink jet recording apparatus according to claim 1, wherein said controlling rotary member is positioned on the downstream side of all gap portions in said conveyance route with respect to said pinch rollers used for conveying the recording medium.

3. An ink jet recording apparatus according to claim 1 or 2, wherein said ink jet recording means comprises an ink jet recording head which includes an electrothermal converting element for generating thermal energy and discharges ink using the thermal energy generated with the electrothermal converting element.

4. An ink jet recording apparatus according to claim 1 or 2, wherein said controlling rotary member is also provided on the downstream side in said conveyance route with respect to said pinch rollers.

5. An ink jet recording apparatus according to claim 4, wherein said ink jet recording means comprises an ink jet recording head which includes an electrothermal converting element for generating thermal energy and discharges ink using the thermal energy generated with the electrothermal converting element.

6. An ink jet recording apparatus according to claim 1 or 2, wherein an expelling roller is provided on the downstream side of said ink jet recording area in said conveyance route for making contact with the back side of the recording medium to expel the recording medium from said ink jet recording area, and the expelling roller does not make contact with said controlling rotary member.

7. An ink jet recording apparatus according to claim 6, wherein said ink jet recording means comprises an ink jet recording head which includes an electrothermal converting element for generating thermal energy and discharges ink using the thermal energy generated with the electrothermal converting element.

8. An ink jet recording apparatus according to claim 6, wherein said controlling rotary member is also provided on the downstream side in said conveyance route with respect to said pinch rollers.

9. An ink jet recording apparatus according to claim 8, wherein said ink jet recording means comprises an ink jet recording head which includes an electrothermal converting element for generating thermal energy and discharges ink using the thermal energy generated with the electrothermal converting element.

10. An ink jet recording apparatus according to claim 6, wherein an expelling rotary member which makes contact with the recording surface side of the recording medium to sandwich and convey the recording medium together with said expelling roller is provided.

11. An ink jet recording apparatus according to claim 10, wherein said ink jet recording means comprises an ink jet recording head which includes an electrothermal converting element for generating thermal energy and discharges ink using the thermal energy generated with the electrothermal converting element.

12. An ink jet recording apparatus according to claim 10, wherein said controlling rotary member is also provided on the downstream side in said conveyance route with respect to said pinch rollers.

13. An ink jet recording apparatus according to claim 12, wherein said ink jet recording means comprises an ink jet recording head which includes an electrothermal converting element for generating thermal energy and discharges ink using the thermal energy generated with the electrothermal converting element.

14. An ink jet recording apparatus according to claim 6, wherein said expelling roller comprises a member which alternately provides a large diameter portion and a small diameter portion in the axial direction, an expelling rotary member which makes contact with the recording surface side of the recording medium to sandwich and convey the recording medium together with said expelling roller is provided at said large diameter portion, and said controlling rotary member which is positioned between adjacent large diameter portions is provided at said small diameter portion without making contact with said small diameter portion.

15. An ink jet recording apparatus according to claim 14, wherein said ink jet recording means comprises an ink jet recording head which includes an electrothermal converting element for generating thermal energy and discharges ink using the thermal energy generated with the electrothermal converting element.

16. An ink jet recording apparatus according to claim 14, wherein said controlling rotary member is also provided on the downstream side in said conveyance route with respect to said pinch rollers.

17. An ink jet recording apparatus according to claim 16, wherein said ink jet recording means comprises an ink jet recording head which includes an electrothermal converting element for generating thermal energy and discharges ink using the thermal energy generated with the electrothermal converting element.

18. An ink jet recording apparatus according to claim 14, wherein an expelling rotary member which makes contact with the recording surface side of the recording medium to sandwich and convey the recording medium together with said expelling roller is provided.

19. An ink jet recording apparatus according to claim 18, wherein said ink jet recording means comprises an ink jet recording head which includes an electrothermal converting element for generating thermal energy and discharges ink using the thermal energy generated with the electrothermal converting element.

20. An ink jet recording apparatus according to claim 18, wherein said controlling rotary member is also provided on the downstream side in said conveyance route with respect to said pinch rollers.

21. An ink jet recording apparatus according to claim 20, wherein said ink jet recording means comprises an ink jet recording head which includes an electrothermal converting element for generating thermal energy and discharges ink using the thermal energy generated with the electrothermal converting element.

* * * * *